United States Patent [19]

Francke et al.

[11] 3,988,557

[45] Oct. 26, 1976

[54] LIGHTED PUSHBUTTON ELECTRICAL SWITCH ASSEMBLY

[75] Inventors: Richard C. Francke, Streamwood; John A. Koepke, Des Plaines, both of Ill.

[73] Assignee: Illinois Tool Works Inc., Chicago, Ill.

[22] Filed: Jan. 27, 1975

[21] Appl. No.: 544,546

[52] U.S. Cl. ..... 200/314; 340/151

[51] Int. Cl.[2] ..... H01H 9/16

[58] Field of Search ..... 200/314, 313, 310, 311, 200/312, 317; 240/151, 152; 340/366 E, 366 F, 366 G; 315/133; 339/14 L; 307/157

[56] References Cited

UNITED STATES PATENTS

| | | | |
|---|---|---|---|
| 1,930,326 | 10/1933 | Thomas | 307/157 |
| 3,773,999 | 11/1973 | Groezinger | 200/314 |
| 3,947,651 | 3/1976 | Fuller | 200/314 |

*Primary Examiner*—James R. Scott
*Assistant Examiner*—Morris Ginsburg
*Attorney, Agent, or Firm*—Glenn W. Bowen; Robert W. Beart

[57] ABSTRACT

A lighted pushbutton electrical switch assembly for either one light or two light operation is provided with a switching mechanism that has one or more upwardly projecting depressible actuating members and a plurality of terminal leads which pass up the outside of the housing to the top of the housing where they are terminated in connecting pads with a pad at each of the four corners of the housing and one in the center which is electrically connected to one of the corner pads. An outer housing receives the switching mechanism in its lower end and a lens section in its open upper end. An intermediate horizontal partition in the housing retains a plurality of conductive coil springs to make contact between the connecting pads and the bulbs. The pushbutton member for actuating the switch receives the light bulbs in apertures in its base. Electrical contacts secured on the pushbutton member complete the circuit for the light bulbs.

7 Claims, 9 Drawing Figures

112
109
110
110
120
144
116
114
102
106
74
72
73
74
70
71
42
54
64
58
60
62
44
50
56
52
66
46
20
38
22
40

7

109
112
78
92
83
76
84
80
82
98
81
96
94
7
86
90
91

132
142
138
136
140
142
126
134
130
132
120
132
128
124
122
116

140
142
138
76
72

148
146
146
126
144
122

148
146
76
72
91
90
86

LIGHTED PUSHBUTTON ELECTRICAL SWITCH ASSEMBLY

BACKGROUND OF THE INVENTION

Lighted pushbutton electrical switch assemblies may be constructed so that a single bulb is lit when the pushbutton is actuated, thereby indicating that the switch is on. Alternatively, lighted pushbutton switch assemblies are used in which one bulb is lit so as to display one color when the switch is in its one position and another bulb is lit so as to display a different color when the switch is in its other position. In the past, if a user wished to utilize both types of lighted pushbutton switches in a single piece of equipment, he generally would have to buy two different types of assemblies.

There have been some specialized prior pushbutton switch assemblies which allowed for the removal of one of the two bulbs in the switch assembly when a single light was desired. In this type of switch assembly, however, the lights were positioned at opposite corners in the two light version; and when one of the bulbs was removed, poor lighting resulted, with the light intensity varying significantly from one side of the lens to the other. Another type of prior pushbutton switch assembly utilized both of the bulbs for both applications so that when the switch assembly was dark, both bulbs would be off; but when the switch was on, two bulbs instead of one would be lit when a single light would have been adequate. It is, therefore, the object of the present invention to provide a lighted pushbutton electrical switch assembly which allows the customer the option of using either one or two lights in the same basic relatively low cost switching unit which has uniform lighting intensity and which does not require the use of any unnecessary bulbs for either application of the switch assembly.

DESCRIPTION OF THE DRAWINGS

The present invention is illustrated by reference to the drawings in which.

TECHNICAL DESCRIPTION OF THE INVENTION

Figure 1:
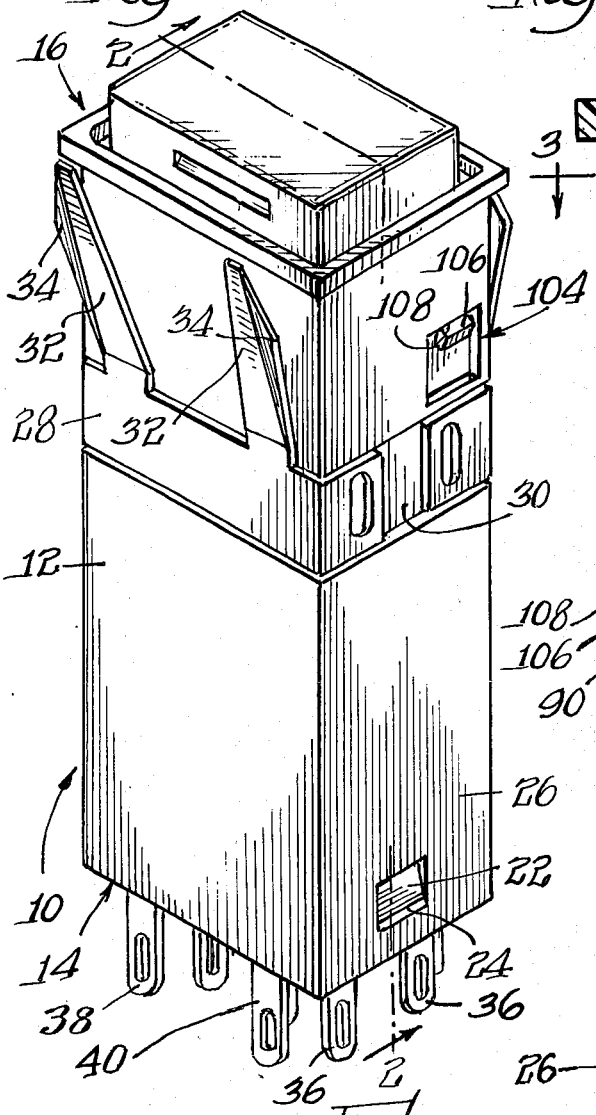
FIG. 1 is a perspective view of a completed switch assembly constructed in accordance with the present invention.
Figure 2:
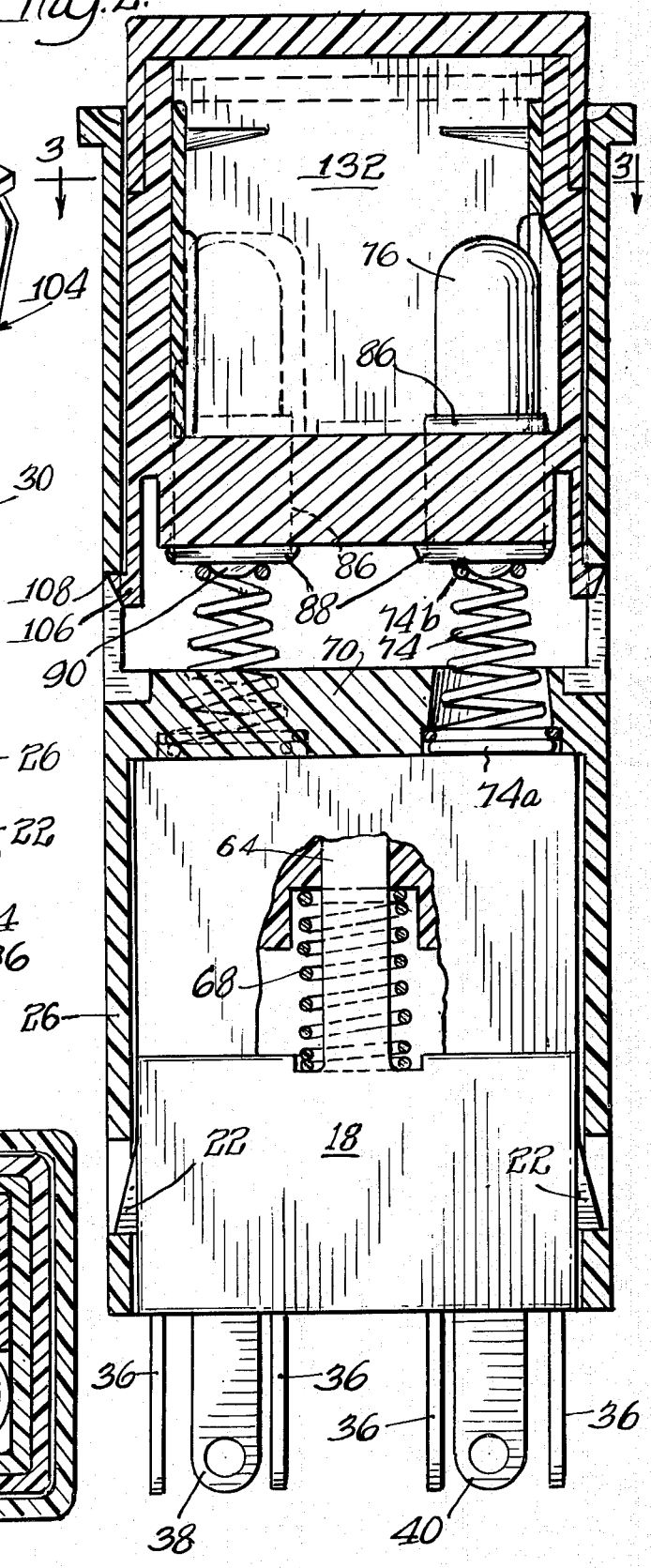
FIG. 2 is a partial cross-sectional view of the switch assembly of FIG. 1 taken along the lines 2—2 of FIG. 1.
Figures 4, 5, 6, 7, 8, 9:
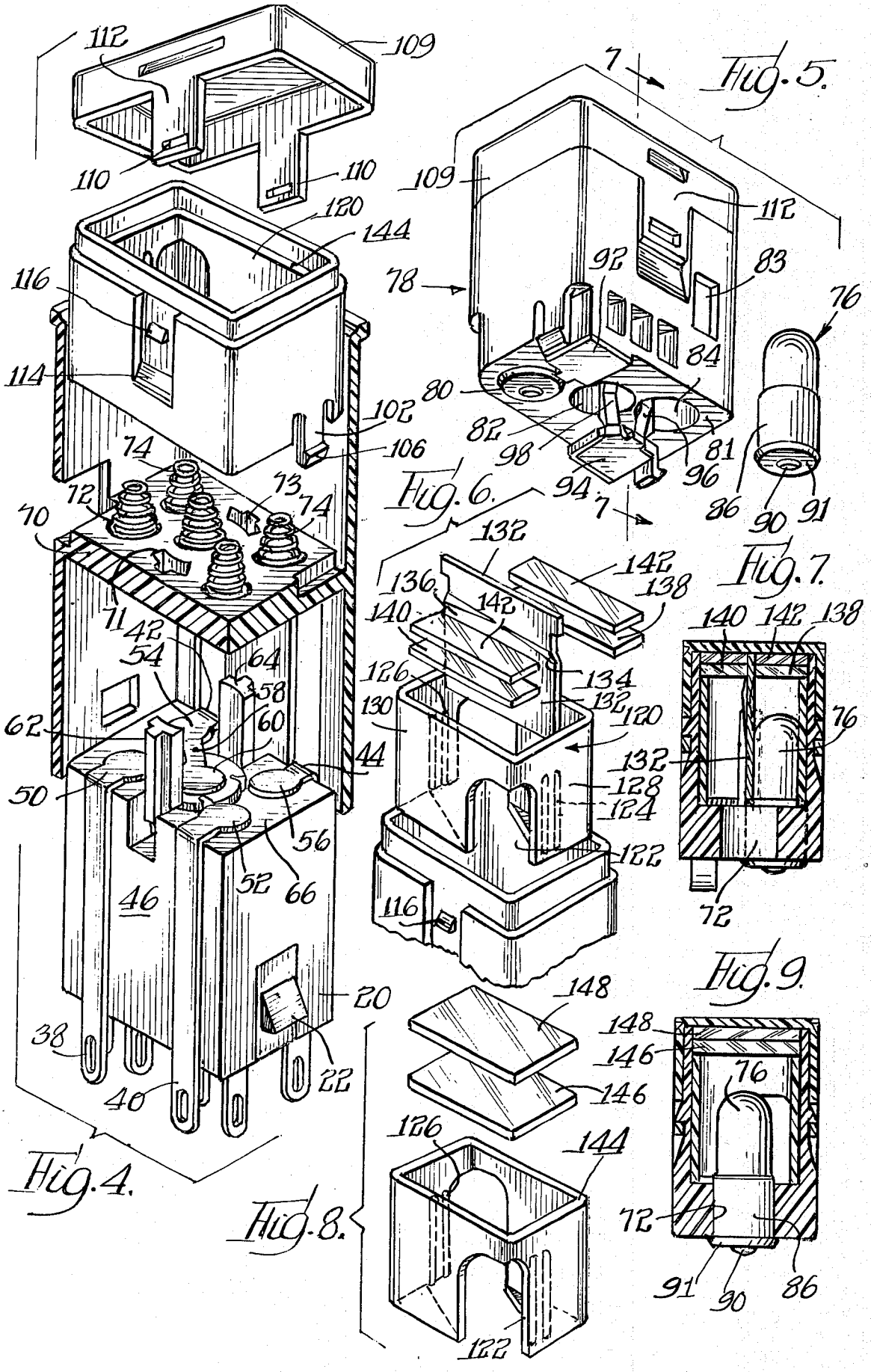
FIG. 4 is an exploded perspective view of the switch assembly of FIG. 1.
FIG. 5 is a perspective view showing the pushbutton and bulb and screen retaining member.
FIG. 6 is a perspective view which shows the bulb and screen retaining elements of the pushbutton member when the switch is used for two light operation.
FIG. 7 is a side cross-sectional view of the bulb and screen retaining elements of FIG. 6.
FIG. 8 shows the bulb and screen retaining elements of the pushbutton member when the switch is used for single bulb operation.
FIG. 9 is a cross-sectional view of the bulb and screen retaining elements of FIG. 8.

A lighted pushbutton electrical switch assembly constructed in accordance with the present invention is shown in FIGS. 1, 2 and 4. The switch assembly includes a housing 12 which has an open lower end 14 and an open upper end 16. A switching mechanism 18, which may be constructed internally in accordance with any conventional switching design, is contained in the housing 20 and is inserted into the lower opening 14 so that a pair of triangular shaped locking members 22 on the switch assembly project into apertures 24 in the side walls 26 of the housing 12 in order to lock the switching mechanism 18 in place.

A panel locking member 28 constructed of spring metal is removably secured in a groove 30 which encircles the upper portion of the housing 12. The spring locking member has four resilient arms 32 on it which extend outwardly and which have generally triangular shaped projections 34 which are bent outwardly at an angle from the remainder of the arms. These arms serve to secure the switch assembly 10 into place in a mounting panel (not shown).

The switching mechanism 18 includes a number of electrical terminal leads 36 which project into the housing 20 of the switching mechanism 18. There are also four terminal leads 38, 40, 42, 44 which are secured to the outside of the housing 20 so that the terminal leads 38, 40 pass up the side wall 46, while the terminal leads 42, 44 pass up the opposite side wall. The top parts of the terminal leads 38, 40, 42, 44 are bent over onto the upper surface 66 of the housing 20, and they terminate in connecting pads 50, 52, 54, 56, respectively, adjacent the four corners of the housing. The terminal lead 42 also has an extending connecting strip 58 which connects a centrally located connecting pad 60 to the pad 54 at one corner of the housing 20, (the upper corner in FIG. 4).

The actuating plunger for the switch consists of a pair of depressible members 62, 64 (FIG. 4) which project through the upper surface 66 of the housing 20. The members 62, 64 are returned to their uppermost position each time they are depressed by means of a conventional return bias spring 68, shown in FIG. 2.

Intermediate the open ends 14, 16 of the housing 12, there is a horizontally disposed partition 70 (FIGS. 2 and 4) which is formed with five apertures 72 in it spaced to form an "X" and apertures 71, 73 (FIG. 4) which receives the upper parts of the depressible members 62, 64. A coil spring 74 is inserted into each of the apertures 72 from below the partition 70. The springs 74 are constructed so that they are wider at their base 74*a* then they are at their top 74*b*. Thus, the base of the spring 74 will be retained so that it is not allowed to pass through the aperture 72, while the remaining portion of the spring can pass through the aperture.

The bulb holding and screen retaining pushbutton member 78 is shown in FIG. 5. Three apertures 80, 82, 84 are provided in the base 81 to receive the bulbs 76. The bulbs 76 each have a base 86 which is formed with an enlarged rim 88 that allows the bulb to pass only part way into the apertures 80, 84. Electrical connection to the central terminal 90 which projects from the bottom of the bulb 76 to one of the connecting pads 52, 54, 60 is provided by the corresponding coil spring 74. The terminal 90 of the bulb 76 is insulated from the base 86 by means of an insulator 91 so that the base 86 can serve as the other terminal for the bulb. Electrical connection to the base 86 is made through the contacts 92, 94 which are secured on diagonally oppositely opposed corners of the member 78. The contacts 92, 94 each have an extension finger 96 which extends into an aperture 80, 84 and another finger 98 which extends into the central aperture 82 from the contact 94.

The apertures 80, 84 in the corners of the member 78 each receive a bulb when a two light version of the switch is desired. When bulbs are fitted into the apertures 80, 84, no bulb will be inserted into the central aperture 82. If, on the other hand, it is desired to employ a single light switch assembly, no bulbs will be in the apertures 80, 84; but a bulb will be inserted into the central aperture 82.

The pushbutton and bulb and screen retaining member 78 is locked into place in the housing 12 by means of a pair of locking legs 102 (FIG. 4) disposed on opposite sides of the member 78 so that the feet 106 on the bottom of the legs 102 lock against the upper surfaces 108 of the slots 104 (FIG. 1). A transparent or translucent removable cover 109 (FIG. 4) for the member 78 is locked into place by means of slots 110 in downwardly projecting legs 112 disposed in the grooves 114 which receive the locking lips 116.

Figure 3:
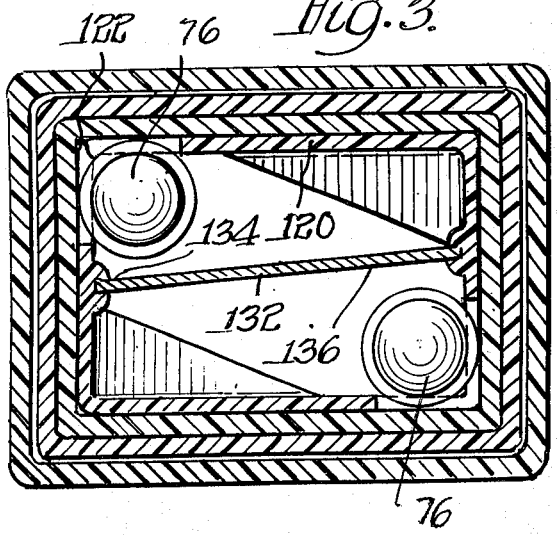
FIG. 3 is a top view looking into the switch assembly housing of FIG. 1 with the pushbutton member removed.

When a two bulb configuration is desired, a hollow insert frame 120 is positioned in the member 78. The insert frame 120 has a pair of cut-outs 122 for receiving a portion of the bulbs therein; and in addition, it has a pair of grooves 124, 126 in opposite side walls 128, 130 which receive a metal divider 132. The lower part of the metal divider 132 has one portion 134 which is slightly bent in the forward direction, as viewed in FIG. 6, and a second portion 136 which is bent in the rear direction in order to reduce the overall width of the switch assembly, as best shown in FIGS. 3, 6 and 7. A plastic lens 138 of a desired color is positioned on one side of the divider 132; and another plastic lens 140, preferably of a different color, is positioned on the other side of the divider 132. A diffusion screen 142 is then inserted over each of the lenses 138, 140, as shown in FIGS. 6 and 7. The top 144 of the insert frame 120 serves to support the lenses 138, 140 at the proper height when they are positioned in the member 78. The cover 109, which may be labelled with a suitable legend, is then snapped on the members 78. If a single light is needed, the divider 132 is not employed (FIG 8). A single lens 146 is then inserted onto the top 144 of the insert frame 120 and a diffusion screen 148 is positioned over the top of the lens 146, as shown in FIGS. 8 and 9.

In the operation of the switch, the application of force onto the cover 109 causes the pushbutton member 78 to be depressed downwardly against the coil spring 74, thus allowing the locking feet 106 to move downwardly in the slots 104. When this occurs, the depressible members 62, 64 will be pressed downwardly by the base 81 of the member 78 against the bias of the spring 68 and the switch will be operated. The lighted bulbs are turned on by a voltage applied to the terminal leads 38, 40 from a voltage source (not shown) when the switching mechanism 18 is operated.

In the two-bulb version of the switch assembly, the electrical circuit for the bulb in the aperture 80 is completed through a spring 74 to the connecting pad 54 thereby providing electrical connection to the terminal 90 of the bulb, while the connection to the base 86 of this bulb will be made through a second spring 74 to the contact 92. In a similar manner, a bulb in the aperture 84 will have its terminal 90 connected to the connecting pad 52 through another spring 74; while the connection to the base 86 of this bulb will be made through still another spring 74 to the contact 94, which engages the contact 92. When the single light bulb version of the switch is employed, the terminal 90 of the bulb in the aperture 82 will be connected to the connecting pad 60 through a spring 74; while the base 86 of the bulb will be electrically connected through the contact 94 through a different spring 74.

By inserting a shorting bus or plug in the aperture 82, the contacts 92, 94 could be connected together so that a two light switch assembly, which may be operated in a manner identical to the single light assembly, with one actuation of the switch resulting in a dark display; and a second actuation of the switch resulting in a lighted display may also be provided with the basic switch mechanism, if desired.

The invention is claimed as follows:

1. A lighted electrical pushbutton switch assembly suitable for either one light bulb or two light bulb operation comprising an outer housing having first and second open ends, a pushbutton illumination means received in said first open end of said outer housing emitter means for emitting viewing light therefrom, at least one electrical light bulb which is retained in said pushbutton illumination means, said pushbutton illumination means being constructed so that a single light bulb may be retained at a first position therein, or alternately so that second and third electrical light bulbs may be retained therein at second and third positions, respectively, first light contact means for making electrical connection with first terminals of whatever light bulbs are retained in said pushbutton illumination means, an electrical switching mechanism received in said second open end of said outer housing which comprises a depressible means for actuating said switching mechanisms, said pushbutton illumination means being movable with respect to said outer housing for actuation of said switching mechanism by depression of said depressible means, said switching mechanism having an outer housing having an exterior surface, second light contact means for making electrical connection with second terminals of whatever light bulbs are retained in said pushbutton illumination means comprising first, second and third contact pads on said exterior surface of said housing of said switching mechanism which are positioned so they may respectively make electrical connection with second terminals of first, second and third light bulbs, respectively; said first contact pad which makes electrical connection with said second terminal of said first light bulb, being electrically connected to one of said second and said third contact pads.

2. A switching assembly as claimed in claim 1 wherein said first light contact means comprises fourth and fifth contact pads on said exterior surface of said housing of said switching mechamism and said outer housing comprises an intermediate partition having a number of apertures therein which correspond in number to the number of contact pads on said switching mechanism and which overlie said contact pads, a corresponding number of coil spring contact members, each of which are inserted into one of said apertures of said partition so that one end of each of said spring members makes contact with one of said contact pads, said pushbutton illumination means having at least first, second and third apertures for retaining the first, second and third light bulbs respectively therein, each of said apertures in said pushbutton illumination means being positioned to overlie a corresponding aperture in said partition so that electrical contact is made from each one of said contact pads on said switching mechanism through each one of said spring members to either a first or a second terminal of a light bulb in said corresponding aperture in said pushbutton illumination means when said switching mechanism is actuated.

3. A switching assembly as claimed in claim 2 wherein said intermediate partition has additional apertures therein for receiving said depressible means of said switching mechanism to allow for depression of said depressible means by said pushbutton illumination means as it moves relative to said outer housing.

4. An electrical switching mechanism as claimed in claim 2 wherein the contact pads on said switching mechanism and the five coil springs inserted in apertures in said partition are arranged in the form of an "X", the first light bulb is positioned at the center of said "X" when it is the only bulb retained in the pushbutton illumination means and said second and third light bulbs are inserted at diagonally opposed corners of said pushbutton illumination means when two light bulbs are employed in said switch assembly and said first light contact means comprises first and second connectors which are disposed on diagonally opposite corners of the pushbutton illumination means and make contact with said first terminal of any light bulb that is inserted into said pushbutton illumination means through conductive fingers which extend from the connectors into said first, second and third apertures of said pushbutton illumination means.

5. A switching mechanism as claimed in claim 1 wherein contact leads for said switching mechanism extend from said switching mechanism housing and said contact pads on said switching mechanism housing are connected to substantially flat terminal leads which traverse the outer surface of said housing and extend adjacent to said contact leads.

6. An electrical switching mechanism as claimed in claim 3 wherein the five contact pads on the switching mechanism and said five coil springs inserted in apertures in said partition are arranged in the form of an "X", the first light bulb is positioned at the center of said "X" when it is the only bulb retained in said pushbutton illumination means and said second and third light bulbs are inserted at diagonally opposed corners of said pushbutton illumination means when two light bulbs are employed in said switch assembly and said first light contact means comprises first and second connectors which are disposed on diagonally opposite corners of said pushbutton illumination means and make contact with the first terminal of any light bulb that is inserted into said pushbutton illumination means through conductive fingers which extend from said connectors into said first, second and third apertures of said pushbutton illumination means.

7. A switching mechanism as claimed in claim 6 wherein contact leads for said switching mechanism extend from said switching mechanism housing and said contact pads on said switching mechanism housing are connected to substantially flat terminal leads which traverse the outer surface of said housing and extend adjacent to said contact leads.

* * * * *

UNITED STATES PATENT OFFICE

CERTIFICATE OF CORRECTION

Patent No. 3,988,557 Dated October 26, 1976

Inventor(s) Richard C. Francke and John A. Koepke

It is certified that error appears in the above-identified patent and that said Letters Patent are hereby corrected as shown below:

Claim 1, Line 5, the word -- having --should follow the word "housing".

Claim 1, Line 19, "mechanisms" changed to -- mechani sm --.

Signed and Sealed this

Fifteenth Day of February 1977

[SEAL]

*Attest:*

RUTH C. MASON
*Attesting Officer*

C. MARSHALL DANN
*Commissioner of Patents and Trademarks*